US009108118B2

(12) United States Patent
Golad

(10) Patent No.: US 9,108,118 B2
(45) Date of Patent: Aug. 18, 2015

(54) AIR DRIVEN TOY ASSEMBLY

(76) Inventor: Adar Golad, KH Hattem (NL)

( * ) Notice: Subject to any disclaimer, the term of this patent is extended or adjusted under 35 U.S.C. 154(b) by 222 days.

(21) Appl. No.: 13/817,059

(22) PCT Filed: Sep. 1, 2011

(86) PCT No.: PCT/NL2011/050595

§ 371 (c)(1),
(2), (4) Date: Apr. 26, 2013

(87) PCT Pub. No.: WO2012/030219

PCT Pub. Date: Mar. 8, 2012

(65) Prior Publication Data

US 2013/0280982 A1 Oct. 24, 2013

Related U.S. Application Data

(60) Provisional application No. 61/379,750, filed on Sep. 3, 2010.

(30) Foreign Application Priority Data

Sep. 3, 2010 (NL) ..... 2005307

(51) Int. Cl.

| | |
|---|---|
| ***A63H 29/16*** | (2006.01) |
| ***A63H 3/00*** | (2006.01) |
| ***A63H 3/28*** | (2006.01) |
| ***A63H 5/00*** | (2006.01) |
| ***A63H 13/02*** | (2006.01) |
| ***A63H 29/02*** | (2006.01) |

(52) U.S. Cl.

CPC ..... *A63H 29/16* (2013.01); *A63H 3/001* (2013.01); *A63H 3/28* (2013.01); *A63H 5/00* (2013.01); *A63H 13/02* (2013.01); *A63H 29/02* (2013.01)

(58) Field of Classification Search

USPC ..... 446/176, 180, 184, 188, 192, 193, 197, 446/202, 211, 214, 397; 434/126, 276, 300, 434/302, 365

See application file for complete search history.

(56) References Cited

U.S. PATENT DOCUMENTS

| | | | | |
|---|---|---|---|---|
| 2,919,135 | A * | 12/1959 | Marchionda | 273/119 B |
| 4,149,338 | A | 4/1979 | Wol | |
| 4,725,256 | A * | 2/1988 | Sassak | 446/176 |
| 5,261,850 | A * | 11/1993 | Barthold | 446/180 |
| 5,522,756 | A | 6/1996 | Barthold | |
| 5,571,037 | A * | 11/1996 | Sellers | 446/188 |
| 6,331,131 | B1 | 12/2001 | Selevan | |
| 6,422,912 | B1 * | 7/2002 | Summers | 446/184 |
| 6,672,930 | B1 * | 1/2004 | McElhaney | 446/89 |
| 6,722,887 | B2 * | 4/2004 | Polonio | 434/237 |
| 7,144,293 | B2 * | 12/2006 | Mann et al. | 446/184 |
| 7,544,017 | B2 * | 6/2009 | Keagy | 406/13 |
| 7,642,438 | B1 | 1/2010 | Cohen | |

* cited by examiner

*Primary Examiner* — Kurt Fernstrom
(74) *Attorney, Agent, or Firm* — Ladas & Parry LLP

(57) ABSTRACT

The present invention relates to an air driven toy assembly (1) and method therefore, comprising an elongated tube (24) adapted for the passage of a malleable play material, preferably while making unusual and entertaining sound effects. The invention provides several measures which reduce clogging of the play material in the toy assembly.

15 Claims, 6 Drawing Sheets

AIR DRIVEN TOY ASSEMBLY

RELATED APPLICATION INFORMATION

This application is a 371 of International Application PCT/NL2011/050595 filed 1 Sep. 2011 entitled "Air Driven Toy Assembly", which was published in the English language on 8 Mar. 2012, with International Publication Number WO 2012/030219 A1, and which claims priority from Netherlands Patent Application 2005307, filed 3 Sep. 2010, and U.S. Provisional Application No. 61/379,750 filed 3 Sep. 2010, the content of which is incorporated herein by reference.

BACKGROUND

The invention relates to an air driven toy assembly, comprising an elongated hollow tube adapted for the passage of a malleable play material, preferably while making unusual and entertaining sound effects.

U.S. Pat. No. 5,522,756 describes an air driven sound generating toy comprising a housing, air pressure means producing a flow of pressurized air, a sounding tube defining an interior passage and surrounding interior wall, said sounding tube being coupled to said air pressure means and having an open end, and a quantity of malleable play material received within said interior passage, said material tending to adhere to said interior wall, said air pressure means operative to force said malleable play material through said interior passage and to deform said play material and force a portion of said flow of pressurized air past said play material to produce a sound.

Due to the nature of said material to adhere to the interior wall, the material can easily become clogged in the tube or other part of the toy. It is an object of the present invention to provide an air driven toy assembly which is less susceptible to clogging.

SUMMARY OF THE INVENTION

To this end, according to a first aspect the present invention provides an air driven toy assembly comprising air pressure means for producing a flow of pressurized air, a main body comprising a substantially airtight tube having an interior wall defining a through-passage for the passage of a quantity of a malleable play material, the main body further comprising an insert-section for insertion of the play material, said insert-section having an interior wall defining a through-passage and comprising an opening for passage of play material, the through-passage of the insert-section being connected to the through-passage of the tube, wherein the insert-section is provided with an air inlet proximate to and downstream from said opening, said air inlet connecting the through-passage of the insert-section with the air pressure means, wherein the air driven toy assembly further comprises a plug comprising an air-tight wall and an air-permeable wall spaced apart from each other, wherein the air-permeable wall is permeable to air and substantially impermeable to the quantity of play material, and wherein the plug further comprises a gap bounded on one side by the air-tight wall and adjacent on another side to the air-permeable wall, wherein the plug is adapted for having its air-permeable wall fittingly placed in the insert-section downstream of the air inlet, with its air-tight wall substantially closing off the insert-section upstream the air inlet, with said air inlet debouching in the gap.

As the air inlet is not used for the passage of play material but only for the passage of a pressurized air flow, clogging of the air inlet is very unlikely. Play material may be inserted into the insert-section at the opening, which is preferably located at or near the upstream distal end of the insert-section, though it may be located anywhere along the insert-section as long as it is located upstream of the air inlet. When the plug is inserted in the opening of the insert-section, the plug pushes any play material left upstream of the air inlet past the air inlet and towards the tube. Additionally, even though the air inlet may be directed substantially normal to the direction of the through-passage of the insert-section, the pressurized air stream is directed through the air-permeable wall in the downstream direction of the insert-section before reaching the play material. Clogging of the through-passage of the insert-section is thus reduced as motive force of the pressurized air flow impinges on the play material substantially in the downstream direction of the through-passage, and not, for example, normal thereto. Preferably the air pressure means is adapted for forcing said play material through said through-passage of the tube and for forcing a portion of said flow of pressurized air past said play material to produce a sound, thus providing additional entertainment value.

In a preferred embodiment the tube has a substantially constant diameter along its length. Alternatively, the tube may have some relatively narrow and wider portions, especially when the tube has a curves or loops; when the play material is resilient it can easily adapt to such changes in tube diameter.

In an embodiment the air-permeable wall of the plug transitions into a circumferential wall, said air-permeable wall and the circumferential wall of the plug defining an interior open-ended space which faces away from the air-tight wall. Play material in the insert-section can thus be pushed towards the tube first by the circumferential wall, in particular the downstream edge thereof. Next, when some of the play material has occupied the open-ended space both the circumferential wall and the air-permeable wall may be used for pushing the play material. Play material is thus substantially prevented from getting wedged between edges of the plug and the interior wall of the insert-section when the plug is inserted in the insert-section. The circumferential wall is preferably substantially air-tight to further reduce the amount of pressurized air that can flow between the interior wall of the insert-section and the air-permeable wall of the plug when the plug is inserted in the insert-section. Thus a greater part of the pressurized air flow is forced through the air-permeable wall instead of past it.

In an embodiment the insert-section is integral with the tube, allowing easy manufacturing. Alternatively the insert-section and the tube comprise separate parts, with the insert-section preferably comprising a more rigid material which facilitates insertion of the plug, and the tube comprising a more flexible material.

In an embodiment the insert-section is fixedly connected with the tube. Advantageously, play material can be inserted in the insert-section and subsequently transported through the tube, without having to reposition the insert-section with respect to the tube. Moreover, as the connection is fixed, a particularly air-tight connection can be provided between the insert-section and the tube, thus reducing undesirable loss of pressure within the tube during operation of the toy.

In an embodiment the insert-section has an upstream end having an inner diameter which is substantially equal to an outer diameter of the circumferential wall of the plug, allowing easy insertion of the plug while maintaining a relatively air-tight connection between the circumferential wall of the plug and the interior wall of the insert-section.

In an embodiment the insert-section has a downstream end having an inner diameter substantially equal to an inner diameter of the tube directly downstream of the insert-section, said downstream end of the insert-section preferably abutting the tube. The play material is thus moved across a substantially smooth surface when it is moved from the insert-section to the tube.

In an embodiment the air-tight wall and/or the air-permeable wall comprises an O-ring along its edge, to provide additional air-tightness between the plug and the interior wall of the insert-section. The portion of pressurized air flow which is not used for driving movement in the toy is thus reduced. Preferably, when the plug is inserted into the insert-section, the O-rings provide sufficient friction to counteract a force exerted by pressurized air flow on the plug during normal operation.

In an embodiment the air-permeable wall of the plug comprises a wall with a plurality of through-holes having a diameter which does not allow the quantity of play material through, said diameter preferably being less than 3 mm, more preferably less than 1.5 mm, most preferably 1.2 mm. The plurality of holes transforms the pressured air stream into a plurality of smaller pressurized air streams which are directed downstream and preferably evenly distributed over the cross-section of the air-permeable wall. When play material is contacting the air-permeable wall, the plurality of smaller air streams incident on the play material is less likely to blow a hole through a weak spot in the play material than a single pressurized air stream would be. The probability of play material staying lodged in the tube because pressurized air passes through it instead of providing a motive force is thus reduced. In a similar embodiment the air-permeable wall comprises a mesh or the like which does not allow play material through but does allow air to pass through.

In an embodiment the main body further comprises an air driven actuator and the air pressure means are further adapted for providing pressurized air to the air driven actuator. Thus the same air-pressure means are used for driving both movement of the play material through the tube, and for driving one or more air driven actuators. Preferably a single pressurized air stream from the air-pressure means is divided into two substantially equal streams, one for propelling the play matter and the other for driving the air driven actuator. The air driven actuator is preferably visible on the outside of the toy, where can provide an entertaining effect as well as an indication that the toy is functioning correctly; when no air passes through the tube all of the pressurized air is used to drive the actuator which will then appear to move too powerfully and/or continually driven, and when there is insufficient pressure the actuator will not move at all. Preferably the air driven actuator causes movement of a tail shaped part of the main housing.

In an embodiment the plug is provided with a handle for holding the plug, said handle being fixed to the air-tight wall.

In an embodiment the air driven toy assembly comprises a metering cup having one open end and having a volume corresponding to a preferred quantity of play material to be inserted in the insert-section, said metering cup being provided with air holes having a diameter which does not allow the quantity of play material through, said diameter being less than 3 mm, preferably less than 1.5 mm, preferably 1.2 mm. By inserting only a predetermined preferred quantity of material into the insert-section it is prevented that too much material is used which requires more air pressure than available for it to be moved. Likewise it is prevented that too little material is used which would allow the pressurized air stream to simply bypass the play material instead of pushing it in the downstream direction.

In an alternative embodiment the metering cup is integrated in the plug, with the through-passages of the plug coinciding with the air holes of the metering cup, and the circumferential wall of the plug together with the air-permeable wall defining a volume corresponding to a preferred quantity of play material to be inserted into the insert-section.

In an embodiment the main body of the air driven toy assembly has the shape of an animal such as a dog, and/or the air pressure means are housed in a housing having the shape of a leash-handle, providing additional entertainment value. Preferably the housing is at least substantially opaque, though in an alternative embodiment both the tube and at least part of the housing are transparent such that at least part of the progress of the play material through the tube may be seen.

According to a second aspect the present invention provides a method for inserting and transporting a quantity of malleable play material into and through a tube having an upstream opening and a downstream opening, said tube defining a through-passage for said play material and provided with an air inlet proximate to and downstream from its upstream opening, said air inlet connecting the through-passage of the tube with air pressure means, said method comprising the steps of placing a quantity of play material in the upstream opening of the tube, pushing the quantity of play material past the air inlet, closing off the tube upstream of the air inlet using a plug, and activating the air pressure means to provide a flow of pressurized air in the tube, said flow of pressurized air moving the quantity of play material. Preferably the quantity of play material is pushed past the air inlet using the plug.

In an embodiment the quantity of play material to be inserted and transported is a substantially predetermined quantity metered using a metering cup.

In an embodiment the method according to the invention is performed using a toy assembly according to the invention.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
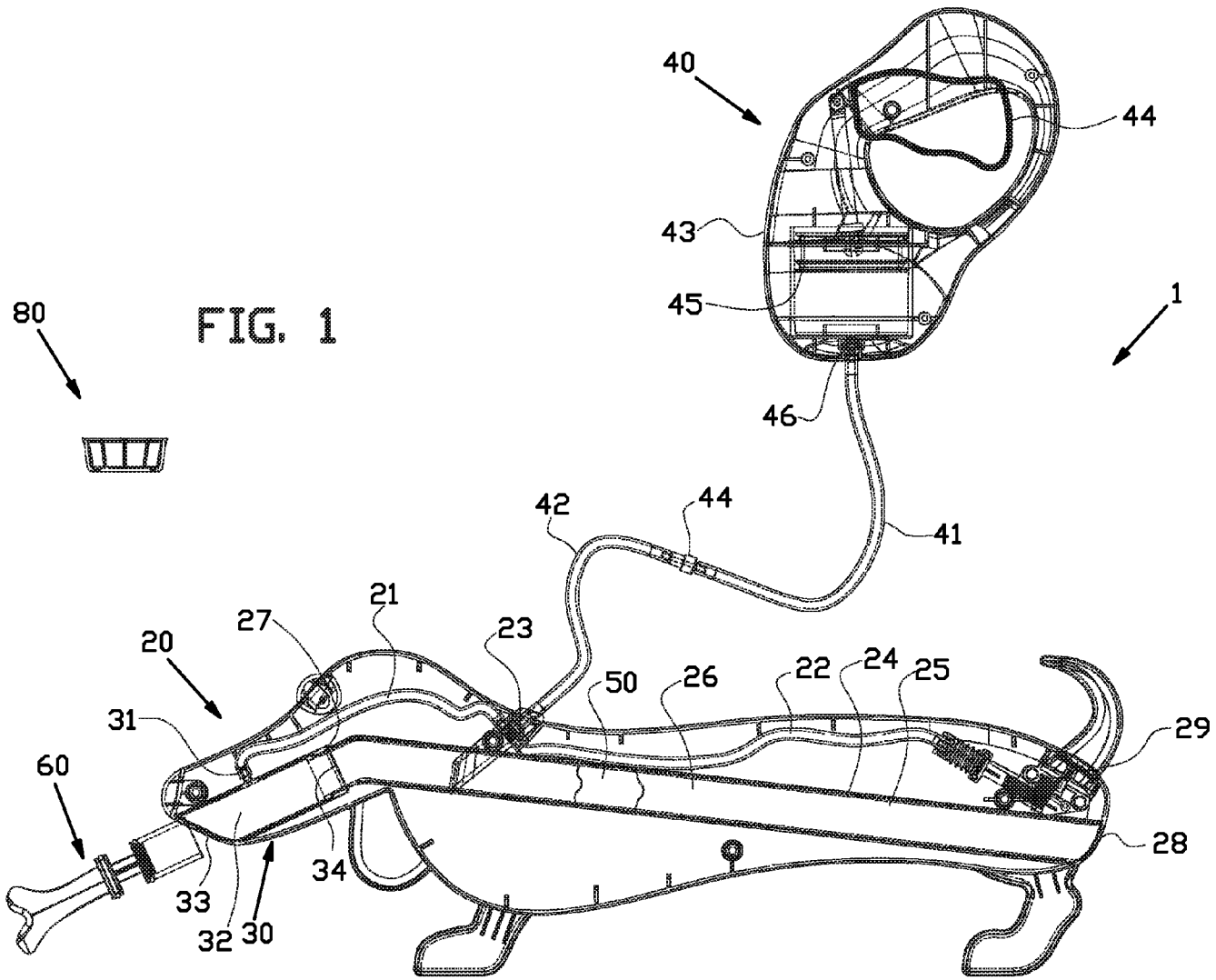
FIG. 1 shows a longitudinal cross-section of an air driven toy assembly according to the invention.

FIG. 1 shows a longitudinal cross section of an air driven toy assembly 1 according to the present invention. The toy assembly comprises a main body 20 through which a quantity of play material 50 is to be propelled by means of a pressurized air stream, air pressure means 40 for providing said pressurized air stream, a plug 60 for sealing off an upstream end of an insert-section 30 of the main body 20 in a substantially air-tight manner, and a metering cup for metering a predetermined quantity of play material 50.

The main body 20 comprises inner air ducts 21,22 and an air flow divider 23 connected to those ducts 21,22, wherein the air flow divider 23 is adapted for substantially equally dividing a flow of pressurized air produced by manually operable air pressure means 40. Air pressure means 40 comprises a housing 43 in the shape of a dog leash handle, and a lever 44 for driving a bellows 45. The bellows is provided with an air valve 46 such that, when the bellows 45 is compressed, a pressurized air stream is directed downstream from the bellows 45 through outer air ducts 41,42 which connect the bellows 45 to the air flow divider 23, but substantially no air is drawn in through the outer air ducts 41,42 when the bellows 45 is expanded. The outer air ducts 41 and 42 are connected to each other by means of an adaptor 44 such that strain on the ducts 41, 42, for instance due to pull on the outer air ducts 41,42 or pressure build-up within these ducts, will cause one or both of the outer air ducts 41,42 to separate from the adapter 44, and not from the air flow divider 23 or from the bellows 45. The outer air ducts 41,42 may be more easily connected or reconnected at the adaptor 44 than at the bellows 45 or the air flow divider 23.

The main body 20, which is shaped as a dog to provide additional entertainment value, further comprises a substantially airtight tube 24 having an interior wall 25 which defines a through-passage 26 for the passage of a quantity of play material 50, in this case a light-weight resilient and amorphous play material, light weight meaning having a density less than water so that the quantity of play material may be moved using relatively little force. The play material is preferably selected to have a tendency to adhere to the tube. The tube 24 extends substantially along the length of the main body 20 and comprises an upstream end 27 and a downstream end 28 for the passage of play material 50, the upstream end 27 of the tube 24 being connected to a downstream end 34 of an insert-section 30. The tube 24 comprises a material flexible enough to allow easy bending of the tube 24 during manufacture of the toy assembly so that it may be easily placed within the main body 20, yet sufficiently rigid to maintain a substantially circular cross section with a constant inner diameter along the length of the tube 24 during use. As a result, when a sufficient quantity amorphous play material 50 is inserted into the tube 24 to be driven through the tube 24 by the pressurized air, the play material 50 will take on a substantially cylindrical shape as defined by the inner wall 25 of the tube 24, and in case of pressure build-up within the tube 24, the tube can expand somewhat and/or the play material can deform somewhat to let some of the pressurized air escape towards its downstream end 28.

Figure 2:
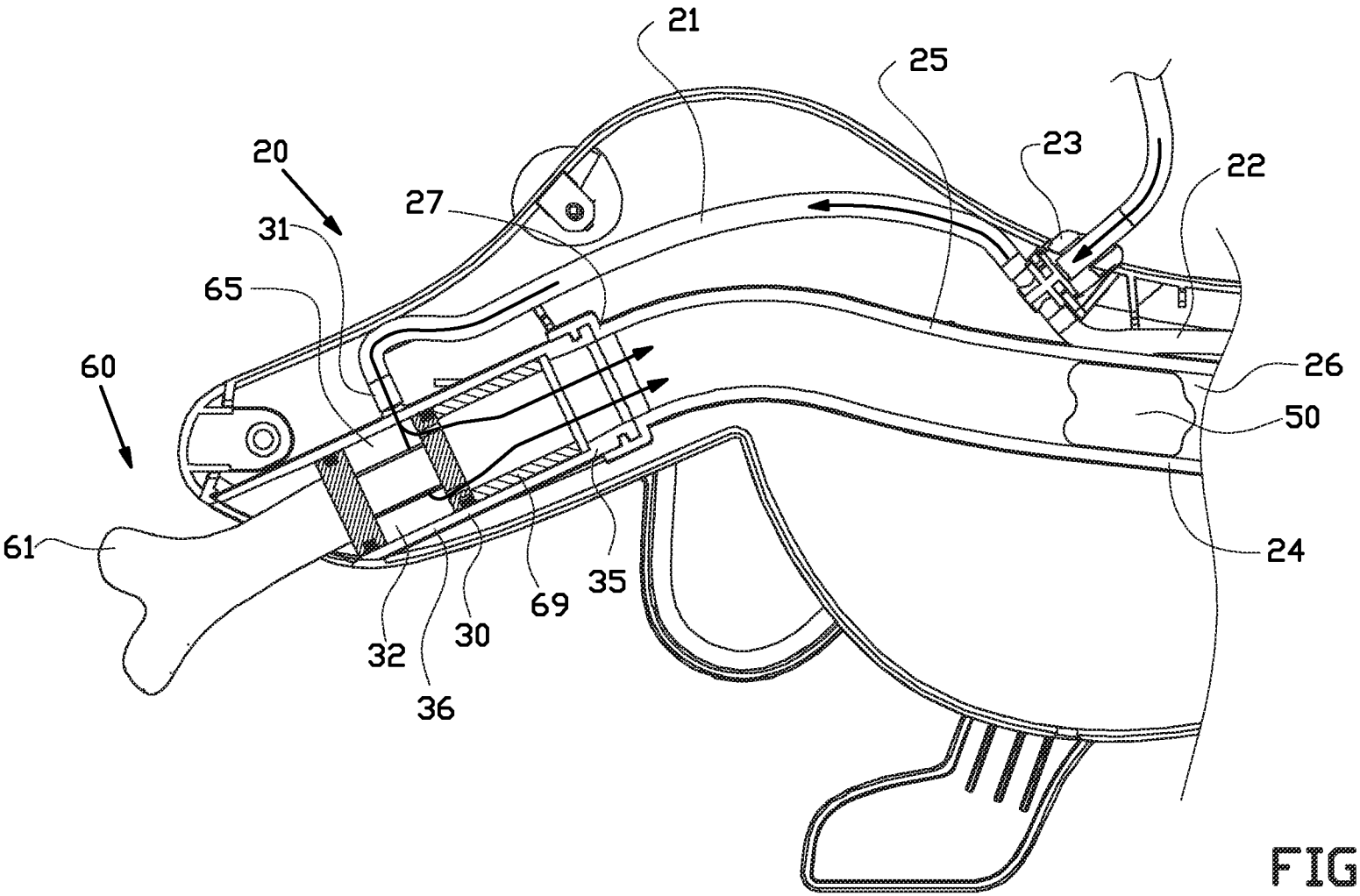
FIG. 2 shows a longitudinal cross-section of a portion of the toy assembly, wherein the plug is inserted in the insert-section.
Figure 3A:
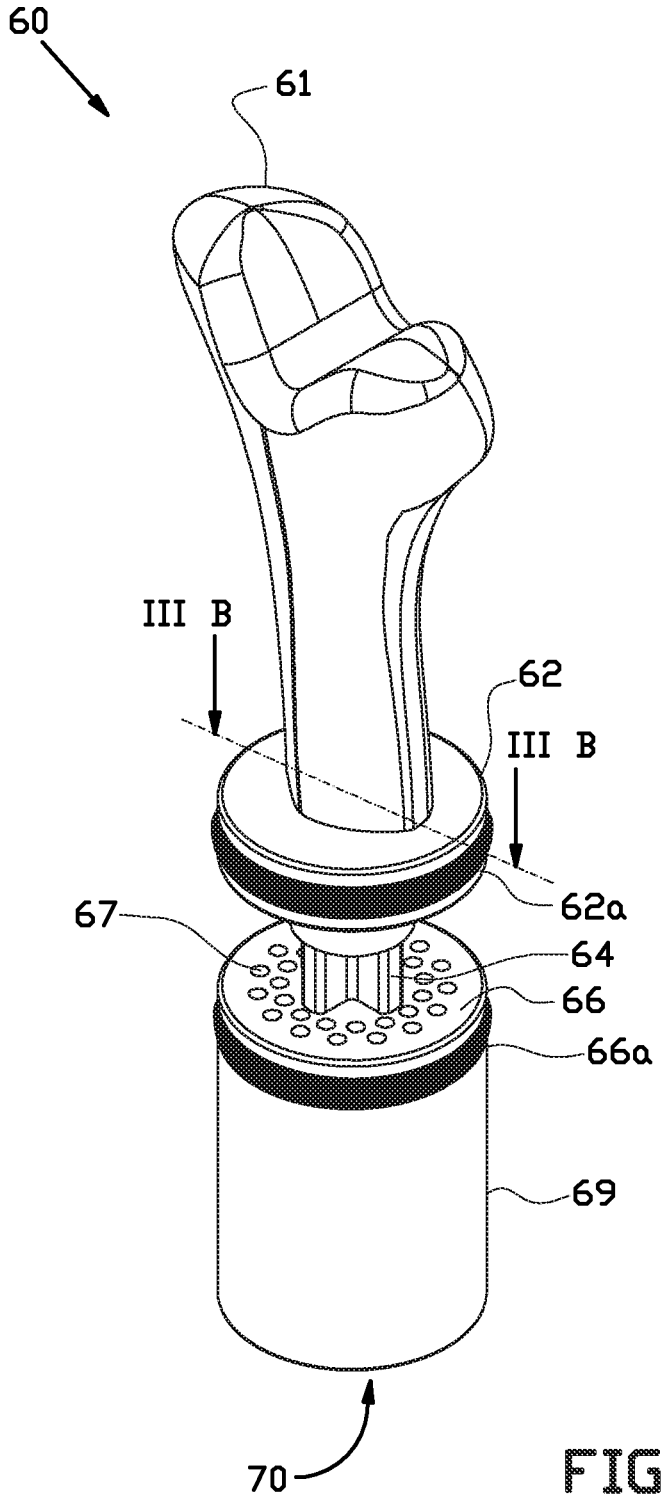
FIGS. 3A,3B and 3C show an isometric view, a longitudinal cross section and a bottom view of a plug of a toy assembly according to the invention.
Figure 3B:
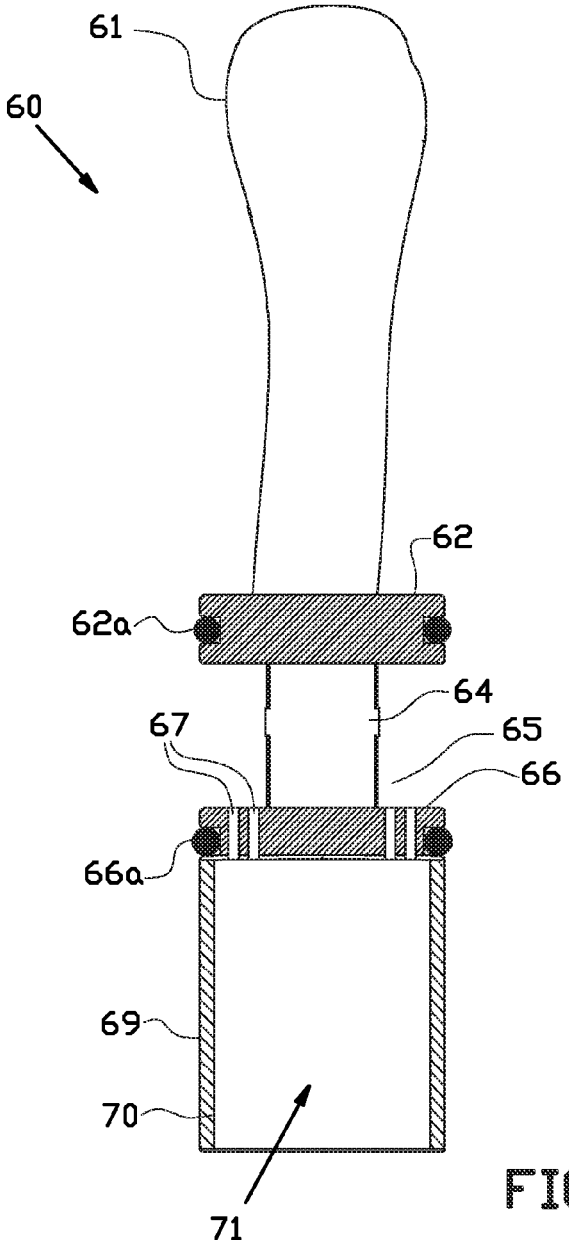

The toy assembly further comprises a plug 60, which is adapted for substantially closing off the upstream end or opening 33 of the insert-section 30. FIGS. 2 and 3A-3B show the insert-section and the plug respectively in greater detail. Referring to FIG. 2, the insert-section has an upstream end 33 and a downstream end 34, wherein the downstream 34 end of the insert-section 30 is fixedly connected to the upstream end 27 of the tube 24. The insert-section 30 comprises a material that is relatively rigid when compared to the material of which the tube 24 is formed, the insert-section 30 being adapted to substantially resist deformation during normal use. The insert-section 30 comprises an air inlet 31 which connects inner air duct 21 on its upstream side to a through-passage 32 of the insert-section 30, and adapted for the passage of a pressurized air flow from the inner air duct 21 to said through-passage. The through-passage 32 is adapted for the passage of both the pressurized air flow and play material 50 in towards the downstream end 28 of the tube. Near the connection of the insert-section 30 with the upstream end 27 of the tube 24, the insert-section is provided with a circumferential abutment edge 35 for abutment with the plug 60.

Figure 3C:
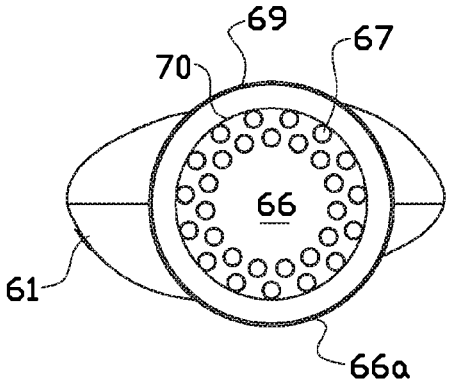

The plug 60, which is shown in greater detail in FIGS. 3A-3C, comprises a handle 61 for holding and manipulating the plug, said handle being shaped as an end of a bone such that when the plug is inserted into the insert-section 30 of the main body, the bone-shaped handle 61 protrudes from the dog-shaped main body 20. The plug 60 further comprises a circular substantially air-tight wall 62 which is provided with a circumferential groove with an O-ring 62*a* to provide additional air-tightness and friction between the air-tight wall 62 of the plug and interior wall 36 of the insert-section. When the plug 60 is inserted into the insert-section 30 as shown in FIG. 2, the air-tight wall 62 and its O-ring 62*a* close off the upstream end 33 of the insert-section 30, i.e. the end of the insert-section upstream of the air inlet 31, in a substantially air-tight manner. The plug 60 further comprises an air-permeable wall 66 which is spaced apart from the air-tight wall 62 by a spacer 64. The spacer 64 has a cross-section, which when projected onto the cross-section of the air-permeable wall 66 and/or of the air-tight wall 62, is substantially smaller than the cross-section of at least one of these walls 62,66 and located at some distance from the edges of the cross-section of at least one of the walls on all sides. Thus a gap 65 is formed between the air-tight wall 62 and the air-permeable wall 66, and a pressurized air flow can traverse the gap before passing through the air-permeable wall 66. This air-permeable wall 66 comprises a plurality of through holes 67 having diameters small enough not to allow the play material to pass through, yet large enough to allow air to pass through, in this case having a diameter of 1.2 mm. Thus, when the play material is close to or contacting the air-permeable wall 66, it will be propelled by a plurality of pressurized air streams instead of by a single air stream, each of the plurality of pressurized air streams providing a smaller force to the a portion of play material than the single air stream would. The chance that excessive force is applied to a small area of the single portion of the play material 50, blowing a hole through the play material instead of propelling it, is thus substantially reduced. The air-permeable wall 66 comprises a groove with an O-ring 66*a* to provide additional air-tightness and friction between the air-permeable wall 66 and the interior wall 36 of the insert-section 30.

The O-rings 62*a*, 66*a* of the plug are adapted to fit sufficiently tight in the insert-section 30 for the plug to withstand the air pressure needed for operating the toy assembly, i.e. for propelling the play material, without substantially displacing the plug. Instead of O-rings on the plug, the insert-section may be provided with inner O-rings, or the plug 60 and/or the insert-section 30 may be provided with a locking mechanism to keep the plug in place.

The air-permeable wall transitions into a circumferential wall 69, an inner side 70 of which defines a hollow space 71 adapted for receiving at least part of the quantity of play material. When play material has been placed manually in the insert-section 30, the plug 60 may be inserted into the insert-section as well, pushing the play material 50 past the air inlet 31. While the play material is pushed towards the downstream end of the tube, the circumferential wall 69 helps in guiding the play material towards 50 the hollow space 71 of the plug and away from the boundary between the interior wall 36 of the insert-section and the circumferential wall. The boundary between the circumferential wall 69 of the plug and the interior wall of the insert-section is thus kept substantially free from the play material. Additionally, when the circumferential wall 69 of the plug hits the abutment edge 35 of the insert-section, any play material contained in the hollow space 71 will be prevented from being lodged between the circumferential wall 69 and the abutment edge 35. When the circumferential wall 69 of the plug abuts with abutment edge 35 of the insert-section 30, the plug is positioned relative to the insert-section such that the air inlet 31 debouches in the gap 65 between the airtight wall 62 and the air-permeable wall 66. The air inlet 31 itself is thus ensured to be open when the plug 60 is completely inserted in the insert-section 30. Next, when the air pressure means 40 are operated, a portion of the generated air pressure stream is directed by the air stream divider to inner air duct 21 which is connected to the air inlet 31. The pressurized air stream passes the air inlet 31 and the gap 65 between the airtight wall 62 and air-permeable wall 66 of the plug, and is split up into a plurality of smaller pressurized air streams when passing through the through-holes 67 in the air-permeable wall 66. These air streams provide a propelling force for the play material 50 downstream of the air-permeable wall 66.

Referring again to FIG. 1, another part of the pressurized air stream from air pressure means 40 is directed through inner duct 22 to an actuator 29 in the shape of a dog's tail. The tail is adapted to move dependent on the air pressure provided thereto, i.e. it wags from side to side under the influence of the provided pressurized air stream. Besides providing entertainment value, the tail 29 serves as an indicator of the amount of air pressure that is available to propel the play material through the main body 20; when too little pressure is available, for instance when there is no play material substantially restricting the passage of air through the tube, the tail will not move, and the position and/or speed of movement of the tail gives an indication of the available air pressure and the power with which it is applied.

Figure 4:
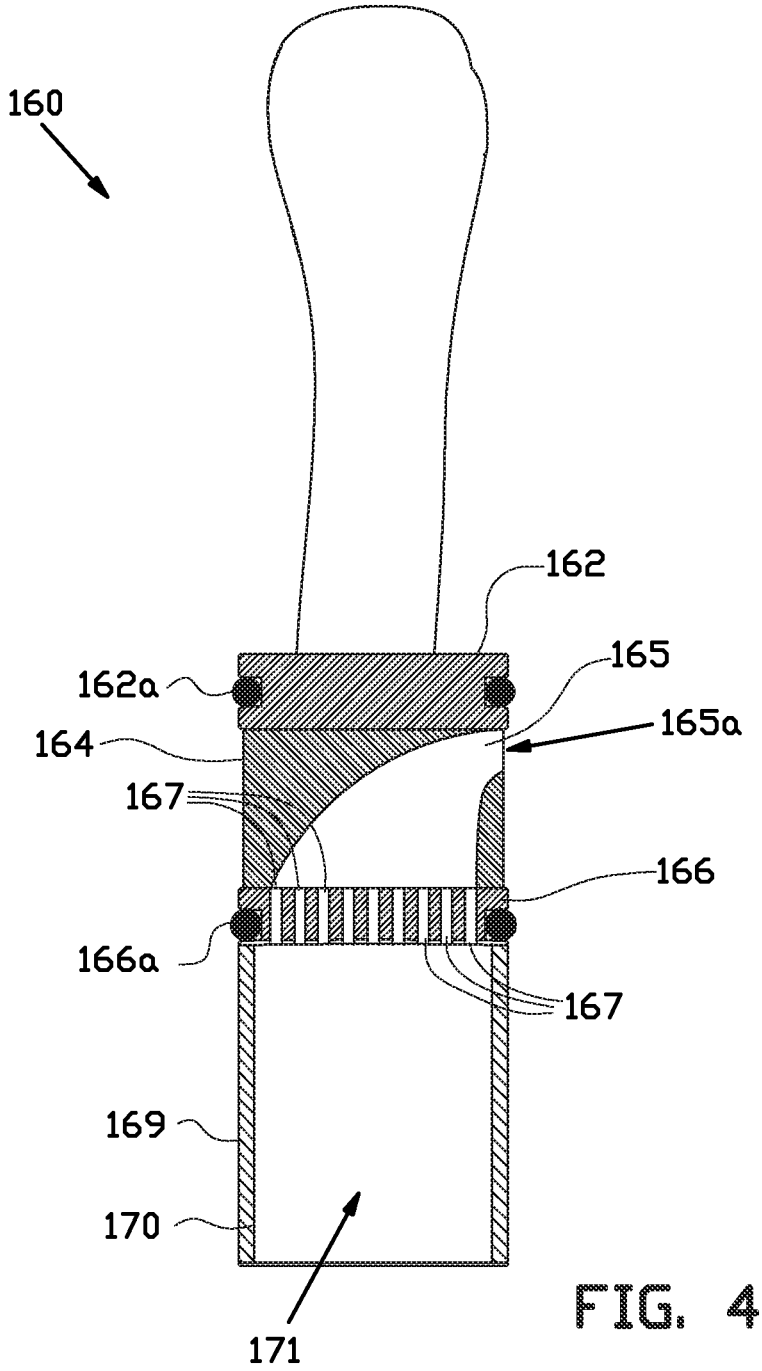
FIG. 4 shows a longitudinal cross section of an alternative embodiment of a plug of a toy assembly according to the invention.

FIG. 4 shows an alternative embodiment of a plug of a toy assembly according to the invention. The plug 160 comprises an air-tight wall 162 provided with an O-ring 162*a* along its circumferential edge, and further comprises an air-permeable wall 166 spaced apart from air-tight wall 162, and provided with an O-ring 166*a* along its circumferential edge as well. A large portion of the space between the air-tight wall 162 and the air-permeable wall 166 is filled by an air-tight spacer 164 which, along the length of the outer face of the plug, has substantially the same contour as the circumferential edges of the air-permeable wall 166 and/or the air-tight wall 162, such that an outer contour of the plug 160 downstream of the airtight wall 162 is substantially circular with a constant diameter, except at air inlet hole 165*a*. The spacer 164 has a hollow interior portion 165, said interior portion providing an air passage between the hole 165*a* and the through holes 167 of the air-permeable wall. When the plug 160 is inserted in the insert-section 30 of the toy assembly, care must be taken to orient it such that the air inlet 31 of the insert-section 30 debouches in the gap formed by interior portion 165 and hole 165*a*. However, the structural integrity of a plug according to this embodiment may be substantially better than that of a plug of the earlier embodiment.

Figure 5A:
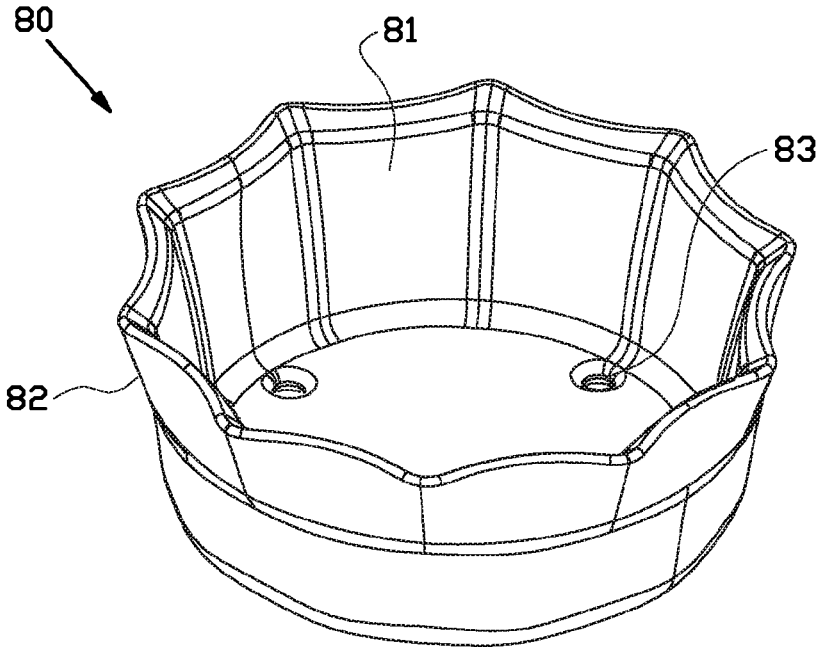
FIGS. 5A and 5B show an isometric view and a top view of a metering cup of a toy assembly according to the invention.
Figure 5B:
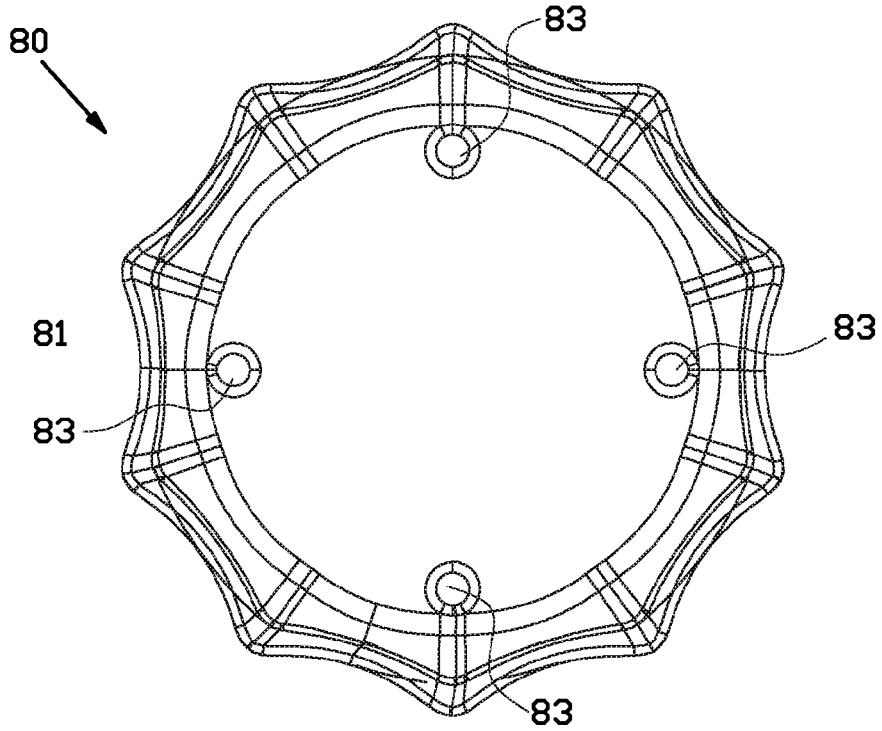

As a further measure to prevent clogging of the play material, the toy assembly provides a metering cup 80 as shown in FIGS. 5A and 5B. The metering cup 80 comprises an inner wall 81 spanning a volume which defines a preferred quantity of play material to be inserted into the insert-section. This preferred quantity of play material is sufficient to form a substantially cylindrical body which fits the interior wall 25 of the tube, while the quantity is chosen such that friction between said cylindrical body 50 and the interior wall 25 is less than the force which will expectedly be provided by the pressurized air stream for propelling the play material through the tube. To allow easy removal of the preferred quantity of play material from the metering cup 80, the cup is provided with through holes 83 which connect the inner wall 81 of the cup with its outer wall 82 and thus help in reducing the forming of a vacuum between the play material and the cup. The cup is provided with through holes 83 having a diameter which allows air through, but does not allow play material through, in this case about 1.2 mm.

When a child wants to insert and transport quantity of malleable play material through a tube 24, he or she may start by placing a quantity of play material in the opening at the upstream end of the tube and pushing the quantity of play material in the downstream direction of the tube past the air inlet. Next the end of the tube upstream from the air inlet 31 is closed off using the plug 60, and the air pressure means 40 are activated to provide a flow of pressurized air in the tube 24. The flow of pressurized air then moves the quantity of play material 50 towards the downstream end 28 of the tube 24. By ensuring that the play material 50 is placed downstream and spaced apart from the air inlet 31 it is ensured that air can flow freely through the air inlet to propel the play material.

Preferably, the quantity of play material to be inserted and transported is a substantially predetermined quantity metered using a metering cup 80. Metering may be done by completely filling the metering cup with play material, and then removing excess material which protrudes past the edges. The air pressure required to propel the play material can thus be predicted in advance, and clogging inside of the tube 24 due to excessive quantities of play material being inserted is avoided. Preferably the quantity of play material is pushed past the air inlet 31 using the plug 60 to avoid fingers getting stuck in the insert-section.

In summary the toy assembly provides an air driven toy assembly, particularly suitable for children as it may be manually operated, i.e. without using external power sources. Additionally, the play material may easily be inserted into the tube and forced through said tube without requiring the tube to be substantially manipulated or disassembled from the main body of the toy assembly.

It is to be understood that the above description is included to illustrate the operation of the preferred embodiments and is not meant to limit the scope of the invention. From the above discussion, many variations will be apparent to one skilled in the art that would yet be encompassed by the spirit and scope of the present invention.

The invention claimed is:

1. Air driven toy assembly (1) comprising:

air pressure means (40) for producing a flow of pressurized air, a main body (20) comprising a substantially airtight tube (24) having an interior wall (25) defining a through-passage (26) for the passage of a quantity of a malleable play material (50), the main body further comprising an insert-section (30) for insertion of the play material (50), said insert-section (30) having an interior wall (36) defining a through-passage (32) and comprising an opening (33) for passage of play material, the through-passage (32) of the insert-section (30) being connected to the through-passage (26) of the tube (24), wherein the insert-section (30) is provided with an air inlet proximate (31) to and downstream from said opening (33), said air inlet (31) connecting the through-passage (32) of the insert-section (30) with the air pressure means (40), wherein the air driven toy assembly (1) further comprises a plug (60,160) comprising an air-tight wall (62,162) and an air-permeable wall (66,166) spaced apart from each other, wherein the air-permeable wall (66,166) is permeable to air and substantially impermeable to the quantity of play material (50), and wherein the plug further (60,160) comprises a gap (65,165) bounded on one side by the air-tight wall (62) and adjacent on another side to the air-permeable wall (66,166), wherein the plug (60,160) is adapted for having its air-permeable wall (66,166) fittingly placed in the insert-section (30) downstream of the air inlet (31), with its air-tight wall (62,162) substantially closing off the insert-section (30) upstream the air inlet (31), with said air inlet (31) debouching in the gap (65,165).

2. Air driven toy assembly according to claim 1, wherein the air-permeable wall (66,166) of the plug (60,160) transitions into a circumferential wall (69,169), said air-permeable wall and the circumferential wall of the plug defining an interior open-ended space (71,171) facing away from the air-tight wall (62,162).

3. Air driven toy assembly according to claim 1, wherein the insert-section (30) is integral with the tube (24).

4. Air driven toy assembly according to claim 1, wherein the insert-section (30) is fixedly connected with the tube (24).

5. Air driven toy assembly according to claim 1, wherein the insert-section (30) has an upstream end (33) having an inner diameter which is substantially equal to an outer diameter of the circumferential wall (69,169) of the plug (60,160).

6. Air driven toy assembly according to claim 1, wherein the insert-section (30) has a downstream end (34) having an inner diameter substantially equal to an inner diameter of the tube (24) downstream of the insert-section.

7. Air driven toy assembly according to claim 1, wherein the air-tight wall (62,162) and/or the air-permeable wall (66, 166) comprises an O-ring (62*a*, 66*a*, 162*a*, 166*a*) along its edge.

8. Air driven toy assembly according to claim 1, wherein the air-permeable wall (66,166) of the plug (60,160) comprises a wall with a plurality of through-holes (67,167) having a diameter which does not allow the quantity of play material (50) through, said diameter being less than 3 mm.

9. Air driven toy assembly according to claim 1, wherein the main body (20) further comprises an air driven actuator (29), wherein the air pressure means (40) are further adapted for providing pressurized air to the air driven actuator.

10. Air driven toy assembly according to claim 1, wherein the plug (60) is provided with a handle (61) for holding the plug, said handle being fixed to the air-tight wall (62).

11. Air driven toy assembly according to claim 1, comprising a metering cup (80) having one open end and having a volume corresponding to a preferred quantity of play material to be inserted into the insert-section, said metering cup being provided with air holes (83) having a diameter which does not allow the quantity of play material through, said diameter being less than 3 mm.

12. Air driven toy assembly according to claim 1, wherein the main body (20) has the shape of an animal, and/or wherein the air pressure means (40) are housed in a housing (43) having the shape of a dog-leash handle.

13. Air driven toy assembly according to claim 1, wherein the air pressure means (40) is adapted for forcing said play material (50) through said through-passage (26) of the tube (24) and forcing a portion of said flow of pressurized air past said play material (50) to produce a sound.

14. Method for inserting and transporting a quantity of malleable play material (50) into and through a tube (24,30) having an upstream opening (33) and a downstream opening (28), said tube defining a through-passage (26, 32) for said play material and provided with an air inlet (31) proximate to and downstream from its upstream opening (33), said air inlet (31) connecting the through-passage (26, 32) of the tube with air pressure means (40), said method comprising the steps of placing a quantity of play material (50) in the upstream opening (33) of the tube, pushing the quantity of play material past the air inlet, closing off the tube upstream of the air inlet (31) using a plug (60,160), and activating the air pressure means (40) to provide a flow of pressurized air in the tube, said flow of pressurized air moving the quantity of play material (50), wherein the quantity of play material is pushed past the air inlet (31) using the plug (60,160).

15. Method according to claim 14 wherein said inserting and transporting a quantity of malleable play material (50) into and through a tube (24,30) is effected in an air driven toy assembly (1) comprising:

air pressure means (40) for producing a flow of pressurized air, a main body (20) comprising a substantially airtight tube (24) having an interior wall (25) defining a through-passage (26) for the passage of a quantity of a malleable play material (50), the main body further comprising an insert-section (30) for insertion of the play material (50), said insert-section (30) having an interior wall (36) defining a through-passage (32) and comprising an opening (33) for passage of play material, the through-passage (32) of the insert-section (30) being connected to the through-passage (26) of the tube (24), wherein the insert-section (30) is provided with an air inlet proximate (31) to and downstream from said opening (33), said air inlet (31) connecting the through-passage (32) of the insert-section (30) with the air pressure means (40), wherein the air driven toy assembly (1) further comprises a plug (60,160) comprising an air-tight wall (62,162) and an air-permeable wall (66,166) spaced apart from each other, wherein the air-permeable wall (66,166) is permeable to air and substantially impermeable to the quantity of play material (50), and wherein the plug further (60,160) comprises a gap (65,165) bounded on one side by the air-tight wall (62) and adjacent on another side to the air-permeable wall (66,166), wherein the plug (60,160) is adapted for having its air-permeable wall (66,166) fittingly placed in the insert-section (30) downstream of the air inlet (31), with its air-tight wall (62,162) substantially closing off the insert-section (30) upstream the air inlet (31), with said air inlet (31) debouching in the gap (65,165).

* * * * *